US011240582B1

(12) United States Patent
Lee

(10) Patent No.: US 11,240,582 B1
(45) Date of Patent: Feb. 1, 2022

(54) EAR TIP INCLUDING STRUCTURE EASILY REMOVABLE FROM MOLD

(71) Applicant: Azla Inc., Seoul (KR)

(72) Inventor: Sang Won Lee, Seoul (KR)

(73) Assignee: Azla Inc., Seoul (KR)

( * ) Notice: Subject to any disclaimer, the term of this patent is extended or adjusted under 35 U.S.C. 154(b) by 0 days.

(21) Appl. No.: 17/217,216

(22) Filed: Mar. 30, 2021

(30) Foreign Application Priority Data

Sep. 1, 2020 (KR) ..... 10-2020-0111308

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC ..... H04R 1/1016; H04R 1/1058; H04R 9/06; H04R 11/02; H04R 1/1066; H04R 1/1033; H04R 1/2807; H04R 1/34; H04R 1/1091; H04R 1/10; H04R 1/345; H04R 29/001; H04R 2499/11; H04R 1/1008; H04R 1/26; H04R 1/2811
USPC ..... 381/380, 381, 370, 382, 384
See application file for complete search history.

(56) References Cited

U.S. PATENT DOCUMENTS

2010/0246879 A1* 9/2010 Siahaan ..... H04R 1/1058 381/380
2016/0173971 A1* 6/2016 Lott ..... H04R 25/659 381/380
2020/0029161 A1* 1/2020 Thumm ..... H04R 25/659

FOREIGN PATENT DOCUMENTS

| | | |
|---|---|---|
| JP | 2010-68299 | 3/2010 |
| JP | 2020-109951 | 7/2020 |
| KR | 10-2008-0079829 | 9/2008 |
| KR | 10-1323805 | 10/2013 |
| KR | 10-1330661 | 11/2013 |
| KR | 10-2013-0136059 | 12/2013 |
| KR | 10-1875670 | 7/2018 |
| KR | 20-2019-0002280 | 9/2019 |
| KR | 10-2020-0045281 | 5/2020 |

* cited by examiner

*Primary Examiner* — Alexander Krzystan
*Assistant Examiner* — Julie X Dang
(74) *Attorney, Agent, or Firm* — Fay Sharpe LLP

(57) ABSTRACT

Disclosed is an ear tip. An ear tip according to an exemplary embodiment of the present disclosure is mounted on one side of an earphone and configured to be inserted into a wearer's external auditory canal to stably fix a position of the earphone. According to the present disclosure, it is possible to provide the ear tip including a structure easily and physically removable from a mold without the aid of a separate chemical substance even though a material having high adhesiveness is applied in a manufacturing process.

4 Claims, 8 Drawing Sheets

[FIG. 4]
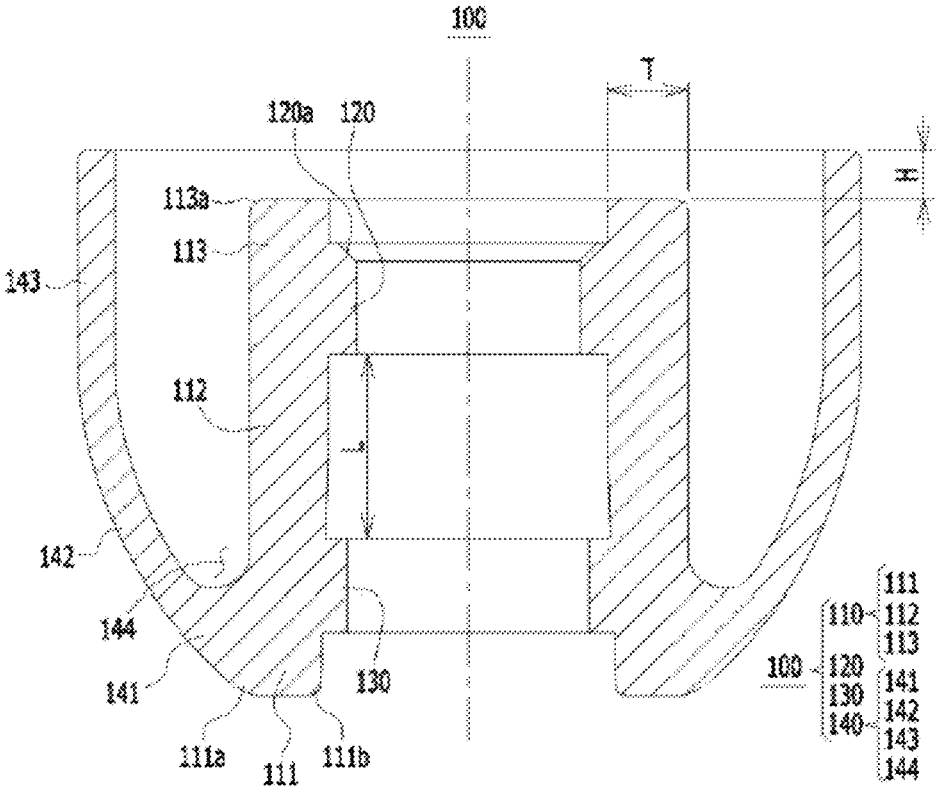

[FIG. 5]
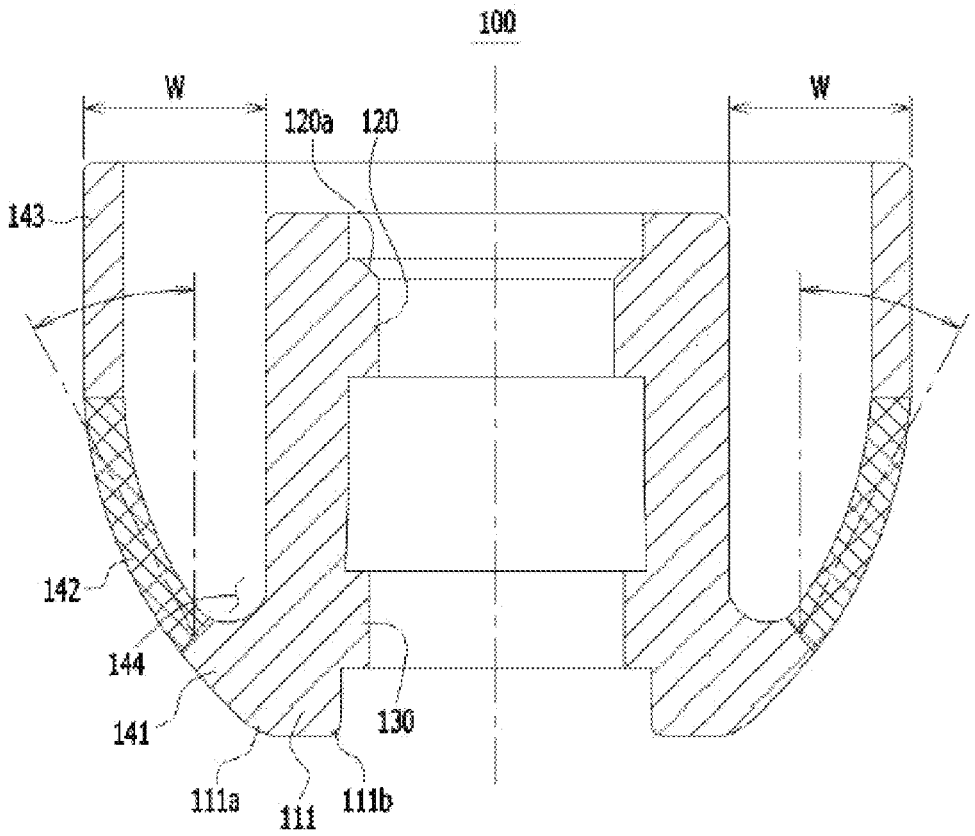

[FIG. 6]
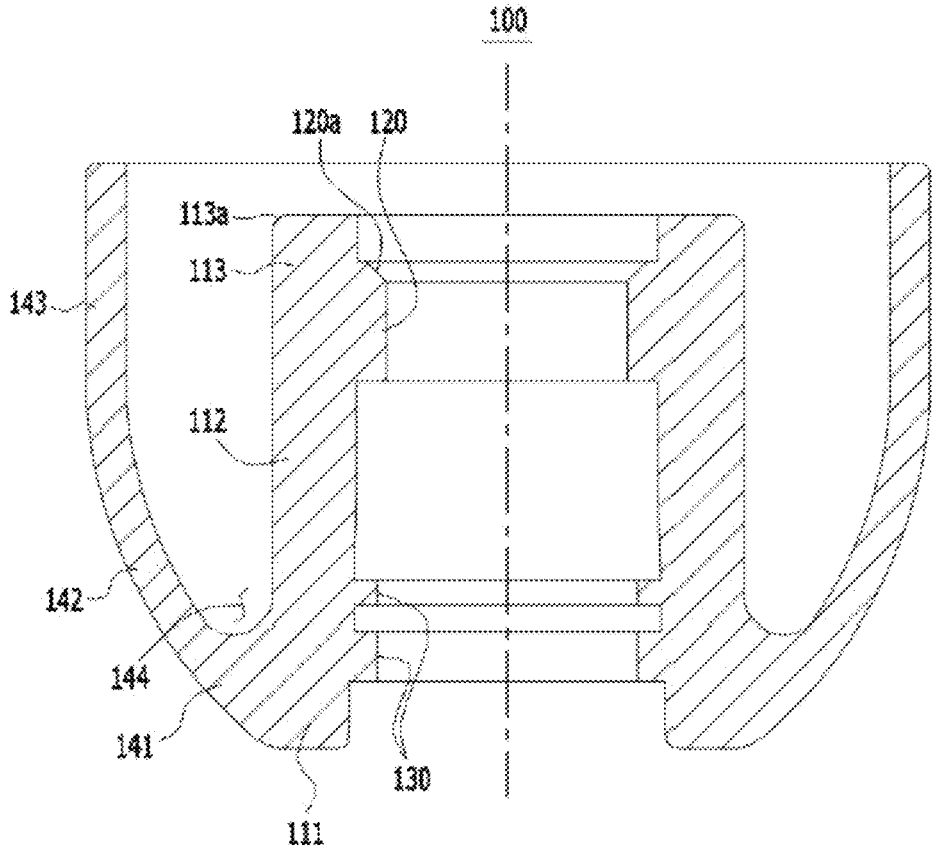

[FIG. 7]
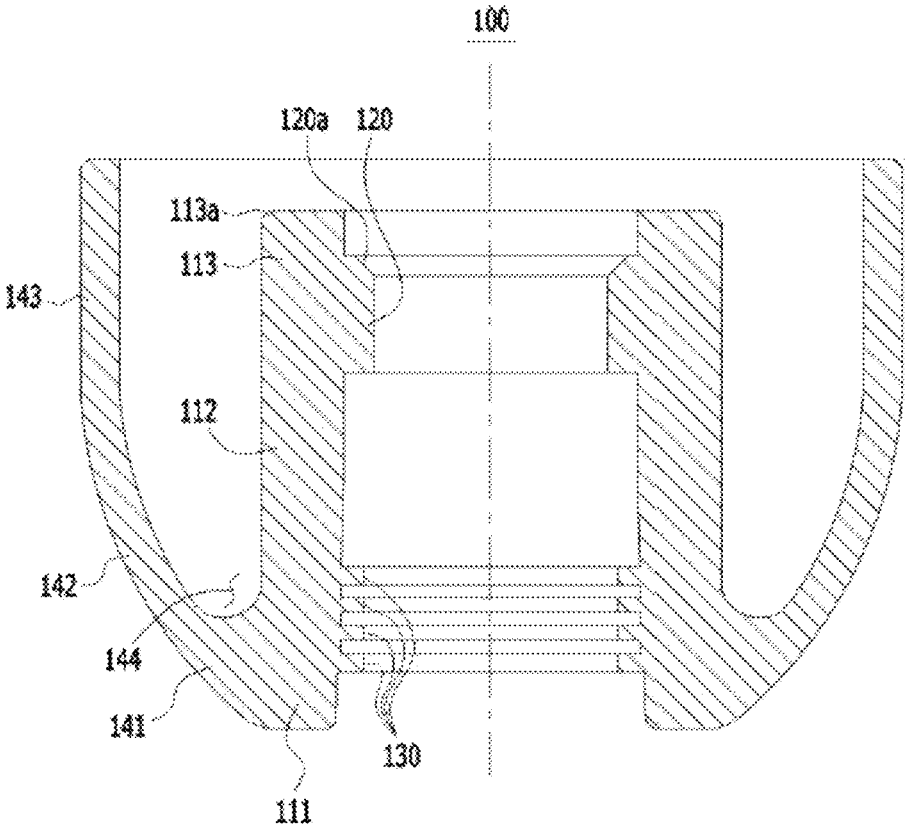

[FIG. 8]
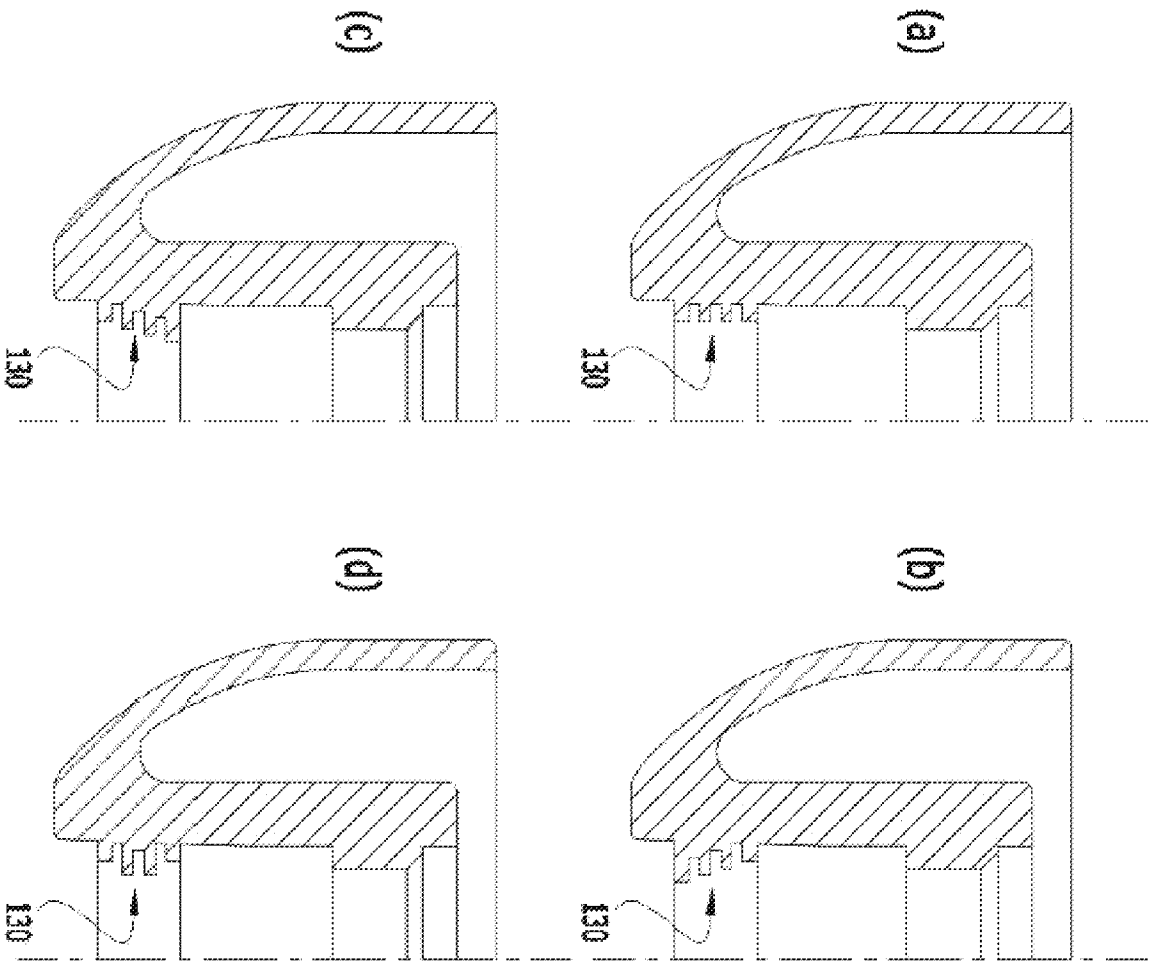

EAR TIP INCLUDING STRUCTURE EASILY REMOVABLE FROM MOLD

CROSS-REFERENCE TO RELATED APPLICATIONS

This application claims the priority of Korean Patent Application No. 10-2020-0111308 filed on Sep. 1, 2020 in the Korean Intellectual Property Office, the disclosure of which is incorporated herein by reference.

BACKGROUND

Field

The present disclosure relates to an ear tip, and more particularly, to an ear tip including a structure easily removable from a mold.

Description of the Related Art

In general, an operator inserts earphones into his/her ears and uses the earphones in order to reduce the amount of noise in a place, such as a factory or a business place, where loud noise is generated or a user inserts earphones into his/her ears and uses the earphones in order to personally listen to voice or music through a device such as a smartphone or an MP3 player. For the convenience of the user who uses the earphones, an ear tip is used by being combined with a portion of each of the earphones which is to be in contact with the user's ear.

As described above, since the ear tip is used while being in contact with the ear, the ear tip is made of a soft material in order to improve wearing comfort. As a related art, Korean Patent No. 1323805 discloses a method of manufacturing an ear tip (see FIG. 1) using silicone. However, in the case in which the ear tip is made of silicone in the related art, a thickness of the ear tip needs to be reduced or strength of the ear tip needs to be reduced in order to increase the user's wearing comfort. The ear tip made of silicone may improve the wearing comfort, but because the ear tip made of silicone has high resilience, there is a disadvantage in that a shape of the ear tip is restored immediately. For this reason, it is necessary to apply pressure to the ear tip in order to insert the ear tip into the ear, and a degree of deformation of the ear tip is standardized, and as a result, there is a problem that a degree of close contact of the ear tip to the ear deteriorates depending on a size of an earhole.

In addition, in the case of manufacturing an ear tip using a material such as polyurethane, which has excellent resilience but is slowly restored, there is a problem in that it is difficult to discharge gas when forming the ear tip that is very small enough to be inserted into the user's ear. In more detail, in the case of generally manufacturing a product using a material such as polyurethane, a gas discharge port needs to be necessarily formed in a mold in order to remove gas generated when forming the product using the material such as polyurethane. However, because the ear tip is formed to be small enough to be inserted into a human ear, it is very difficult to form gas discharge ports in small-sized ear tip molds one by one. Even though the gas discharge port is formed in each of the ear tip mold, it is necessary to remove molding discharges released from the gas discharge ports one by one, and as a result, there is a problem in that unnecessary costs are incurred, and quality of a product deteriorates.

In addition, in the case of manufacturing an ear tip using a material such as silicone or a material such as polyurethane, an end of the ear tip needs to be treated to remove molding discharges. However, a large amount of time and effort are required to manually treat the ends of the small-sized ear tips one by one. In particular, in the case of manufacturing an ear tip having an uneven upper portion, there is a problem in that it is difficult to manually treat the end of the ear tip.

In addition, in the case of manufacturing an ear tip using a material such as thermoplastic elastomer (TPE) or polyurethane, which has excellent resilience but is slowly restored, there is a problem in that it is difficult to discharge gas when forming the ear tip that is very small enough to be inserted into the user's ear.

Specifically, in the case of generally manufacturing a product using a material such as thermoplastic elastomer (TPE) or polyurethane, a gas discharge port needs to be necessarily formed in a mold in order to remove gas generated when forming the product using the material such as thermoplastic elastomer (TPE) or polyurethane.

However, because the ear tip is formed to be small enough to be inserted into a human ear, it is very difficult to form gas discharge ports in small-sized ear tip molds one by one. Even though the gas discharge port is formed in each of the ear tip mold, it is necessary to remove molding discharges released from the gas discharge ports one by one, and as a result, there is a problem in that unnecessary costs are incurred, and quality of a product deteriorates.

Therefore, there is a need for a technology capable of solving the above-mentioned problems in the related art.

SUMMARY

An object of the present disclosure is to provide an ear tip including a structure easily and physically removable from a mold without the aid of a separate chemical substance even though a material having high adhesiveness is applied in a manufacturing process.

In order to achieve the above-mentioned object, one aspect of the present disclosure provides an ear tip, which is mounted on one side of an earphone and configured to be inserted into a wearer's external auditory canal to stably fix a position of the earphone, the ear tip including: a main body part having a hollow cylindrical structure corresponding to an outer circumferential surface of the earphone; a coupling part formed to have a ring structure along an inner circumferential surface of an upper portion of the main body part and having a protrusion structure corresponding to a recessed coupling structure formed on the outer circumferential surface of the earphone; one or more protrusion parts formed to have a ring structure along an inner circumferential surface of a lower portion of the main body part and having a protrusion structure protruding by a predetermined height, the protrusion part being disposed to be spaced apart from the coupling part by a predetermined distance; and an external auditory canal contact part having a structure radially protruding from an outer circumferential surface of a lower end of the main body part and extending upward by a predetermined height, the external auditory canal contact part being configured to contact with an inner surface of the wearer's external auditory canal.

In the exemplary embodiment of the present disclosure, the main body part may include: a lower end portion having inclined portions inclined downward at a predetermined angle and formed in the form of a continuous closed curve on an inner circumferential surface and an outer circumferential surface of the lower end portion so that the lower end portion is smoothly inserted into the inner surface of the wearer's external auditory canal; an intermediate connection portion having a cylindrical structure extending upward by a predetermined height from the lower end portion and configured to continuously connect the lower end portion and an upper end portion; and the upper end portion formed integrally with an upper end of the intermediate connection portion and configured such that an inclined portion inclined upward at a predetermined angle is formed in the form of a continuous closed curve on an outer circumferential surface of an upper end of the upper end portion.

In this case, an inclined portion inclined at a predetermined angle may be formed on an inner circumferential surface of an upper end of the upper end portion and formed in the form of a continuous closed curve along the inner circumferential surface of the upper end of the upper end portion.

In the exemplary embodiment of the present disclosure, an inclined portion inclined at a predetermined angle may be formed on an upper end of the coupling part and formed in the form of a continuous closed curve along an inner circumferential surface of the upper end of the coupling part.

In the exemplary embodiment of the present disclosure, a spacing distance between the coupling part and the protrusion part may correspond to a length of a structure of the outer circumferential surface of the earphone.

In the exemplary embodiment of the present disclosure, an upper end and a lower end of the protrusion part may be perpendicular to the inner circumferential surface of the main body part in a cross-sectional view.

In the exemplary embodiment of the present disclosure, the external auditory canal contact part may include: an external auditory canal insertion lower end portion formed integrally with the outer circumferential surface of the lower end of the main body part and extending upward in a state of being spaced apart from the outer circumferential surface of the lower end of the main body part by a predetermined distance, the external auditory canal insertion lower end portion being configured to form an inner groove together with the outer circumferential surface of the main body part; an intermediate connection portion formed integrally with the external auditory canal insertion lower end portion and extending upward from the external auditory canal insertion lower end portion, the intermediate connection portion having an outer diameter that increases upward in a transverse sectional view; and an upper end portion formed integrally with the intermediate connection portion and extending upward from the intermediate connection portion by a predetermined height, the upper end portion having a hollow cylindrical structure having an outer diameter equal to that of an upper end of the intermediate connection portion.

In this case, a height of the upper end portion of the external auditory canal contact part may be larger than that of the upper end of the main body part by a thickness of the main body part.

In the exemplary embodiment of the present disclosure, the intermediate connection portion may be made of a shape-memory polymer (SMP) configured to be restored to an original state by a temperature of a human body, and after the ear tip is inserted into the wearer's external auditory canal, the intermediate connection portion may be restored to the original state, and the upper end portion of the external auditory canal contact part may be in close contact with the inner surface of the wearer's external auditory canal.

In the exemplary embodiment of the present disclosure, a plurality of the protrusion parts may be formed on the inner circumferential surface of the lower portion of the main body part so as to be spaced apart from one another by a predetermined distance.

In the exemplary embodiment of the present disclosure, the plurality of the protrusion parts may be spaced apart from one another by the predetermined distance and grouped into a single group, and protruding lengths of the plurality of the protrusion parts constituting the single group may relatively increase toward a lower side, a middle side, or an upper side.

As described above, since the ear tip according to the present disclosure has the specific structure including the main body part, the coupling part, the protrusion part, and the external auditory canal contact part, it is possible to provide the ear tip including a structure easily and physically removable from a mold without the aid of a separate chemical substance even though a material having high adhesiveness is applied in a manufacturing process.

In addition, since the ear tip according to the present disclosure has the main body part having the specific structure including the lower end portion, the intermediate connection portion, and the upper end portion, it is possible to provide the ear tip that may be stably mounted on one side of the earphone, may be smoothly inserted into the inner surface of the wearer's external auditory canal, and may stably fix a wearing position after being inserted.

In addition, since the ear tip according to the present disclosure has the external auditory canal contact part having the specific structure including the external auditory canal insertion lower end portion, the intermediate connection portion, and the upper end portion, it is possible to provide the ear tip that may come into surface contact with the inner surface of the wearer's external auditory canal and simultaneously and stably fix the position of the ear tip.

In addition, according to the ear tip according to the present disclosure, since the intermediate connection portion of the external auditory canal contact part is made of a shape-memory polymer (SMP) configured to be restored to an original state by a temperature of a human body, it is possible to provide the ear tip configured such that after the ear tip is inserted into the wearer's external auditory canal, the intermediate connection portion may be restored to the original state and the upper end portion of the external auditory canal contact part may be in close contact with the inner surface of the wearer's external auditory canal.

In addition, according to the ear tip according to the present disclosure, the plurality of protrusion parts is formed on the inner circumferential surface of the lower portion of the main body part so as to be spaced apart from one another by a predetermined distance, and the protrusion parts have the various protruding lengths. As a result, it is possible to provide the ear tip including a structure physically and easily removable from a mold without the aid of a separate chemical substance even though a material having high adhesiveness is applied in a manufacturing process.

BRIEF DESCRIPTION OF THE DRAWINGS

The above and other aspects, features and other advantages of the present disclosure will be more clearly understood from the following detailed description taken in conjunction with the accompanying drawings, in which:

FIG. 4 is a cross-sectional view illustrating the ear tip according to the exemplary embodiment of the present disclosure;

FIG. 5 is a cross-sectional view illustrating an ear tip according to another exemplary embodiment of the present disclosure;

FIG. 6 is a cross-sectional view illustrating an ear tip according to still another exemplary embodiment of the present disclosure;

FIG. 7 is a cross-sectional view illustrating an ear tip according to yet another exemplary embodiment of the present disclosure; and FIG. 8 is a cross-sectional view illustrating an ear tip according to still yet exemplary embodiment of the present disclosure.

DETAILED DESCRIPTION OF THE EMBODIMENT

Hereinafter, exemplary embodiments of the present disclosure will be described in detail with reference to the drawings. Terms or words used in the present specification and the claims should not be interpreted as being limited to a general or dictionary meaning and should be interpreted as a meaning and a concept which conform to the technical spirit of the present disclosure.

Throughout the specification of the present application, when one member is disposed "on" another member, this includes not only a case where the one member is brought into contact with another member, but also a case where still another member is present between the two members. Throughout the specification of the present application, unless explicitly described to the contrary, the word "comprise" or "include" and variations, such as "comprises", "comprising", "includes" or "including", will be understood to imply the inclusion of stated constituent elements, not the exclusion of any other constituent elements.

Figure 1:
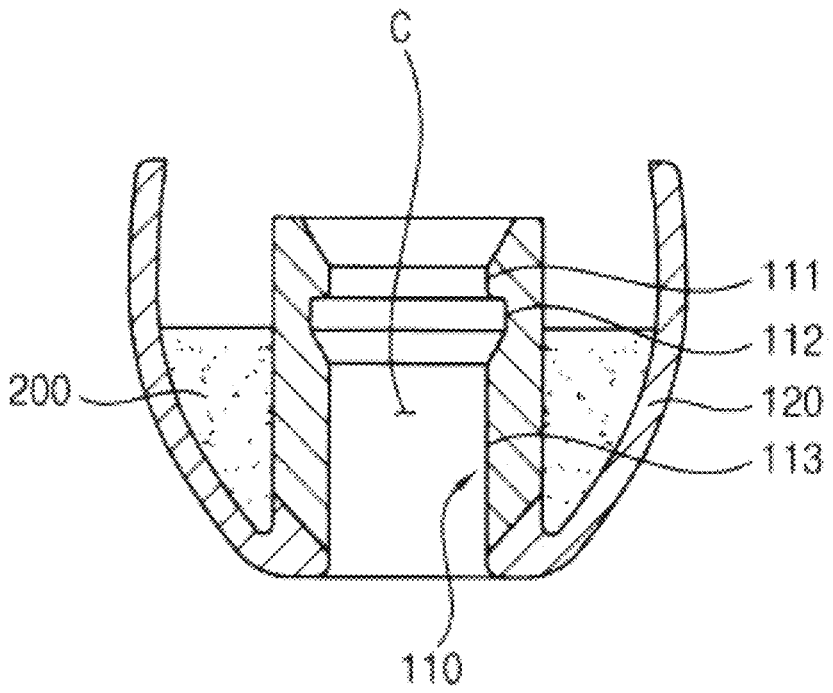
FIG. 1 is a cross-sectional view illustrating an ear tip in the related art.
Figure 2:
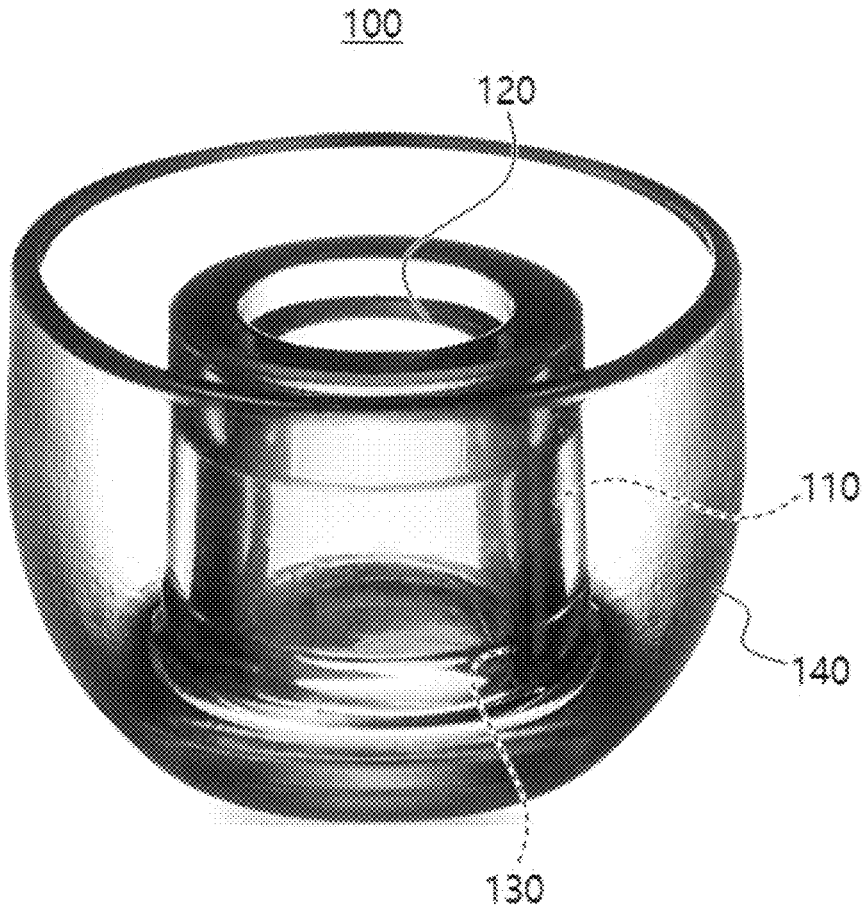
FIG. 2 is a photograph illustrating an ear tip according to an exemplary embodiment of the present disclosure.
Figure 3:
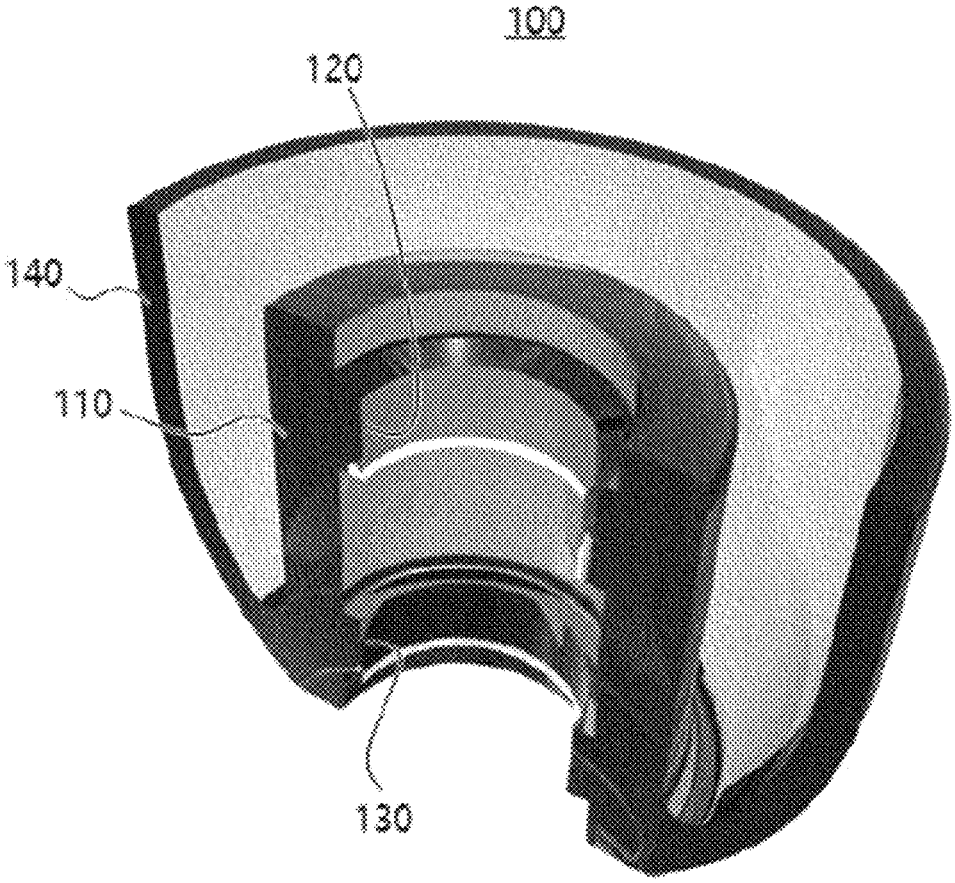
FIG. 3 is a photograph illustrating a cross section of the ear tip illustrated in FIG. 2.

FIG. 2 is a photograph illustrating an ear tip according to an exemplary embodiment of the present disclosure, FIG. 3 is a photograph illustrating a cross section of the ear tip illustrated in FIG. 2, and FIG. 4 is a cross-sectional view illustrating the ear tip according to the exemplary embodiment of the present disclosure.

Referring to these drawings, an ear tip 100 according to the present exemplary embodiment is mounted on one side of an earphone and inserted into a wearer's external auditory canal to stably fix a position of the earphone. The ear tip 100 has a specific structure including a main body part 110, a coupling part 120, a protrusion part 130, and an external auditory canal contact part 140. As a result, it is possible to provide the ear tip including a structure easily and physically removable from a mold without the aid of a separate chemical substance even though a material having high adhesiveness is applied in a manufacturing process.

Hereinafter, respective components constituting the ear tip 100 according to the present exemplary embodiment will be described in detail.

The main body part 110 of the ear tip 100 according to the present exemplary embodiment has a hollow cylindrical structure corresponding to an outer circumferential surface of the earphone.

Specifically, the main body part 110 has a specific structure including a lower end portion 111, an intermediate connection portion 112, and an upper end portion 113.

More specifically, the lower end portion 111 of the main body part 110 may be structured such that inclined portions 111*a* and 111*b* inclined downward at a predetermined angle are formed in the form of a continuous closed curve on an inner circumferential surface and an outer circumferential surface of the lower end portion 111 so that the lower end portion 111 is smoothly inserted into an inner surface of a wearer's external auditory canal.

The intermediate connection portion 112 of the main body part 110 has a cylindrical structure extending upward by a predetermined height from the lower end portion 111 and may continuously connect the lower end portion 111 and the upper end portion 113.

The upper end portion 113 of the main body part 110 is formed integrally with an upper end of the intermediate connection portion 112 and may be configured such that an inclined portion 113*a* inclined upward at a predetermined angle is formed in the form of a continuous closed curve on an outer circumferential surface of an upper end of the upper end portion 113.

In some instances, an inclined portion inclined at a predetermined angle may also be formed on an inner circumferential surface of an upper end of the main body part 110, and the inclined portion may be formed in the form of a continuous closed curve along the inner circumferential surface of the upper end of the main body part 110.

In this case, since the ear tip 100 according to the present disclosure has the main body part 110 having the specific structure including the lower end portion 111, the intermediate connection portion 112, and the upper end portion 113, it is possible to provide the ear tip that may be stably mounted on one side of the earphone, may be smoothly inserted into the inner surface of the wearer's external auditory canal, and may stably fix a wearing position after being inserted.

The coupling part 120 is formed to have a ring structure along an inner circumferential surface of an upper portion of the main body part 110 and may have a protrusion structure corresponding to a recessed coupling structure formed on the outer circumferential surface of the earphone.

Specifically, an inclined portion 120*a* inclined at a predetermined angle may be formed at an upper end of the coupling part 120 and formed in the form of a continuous closed curve along an inner circumferential surface of the upper end of the coupling part 120.

The protrusion part 130 is formed to have a ring structure along an inner circumferential surface of a lower portion of the main body part 110 and may have a protrusion structure protruding by a predetermined height. One or more protrusion parts 130 may be disposed to be spaced apart from the coupling part 120 by a predetermined distance.

Specifically, the protrusion part 130 according to the present exemplary embodiment may be spaced apart from the coupling part 120 by a predetermined distance L. In this case, the spacing distance L between the coupling part 120 and the protrusion part 130 may correspond to a length of a structure of the outer circumferential surface of the earphone.

In addition, an upper end and a lower end of the protrusion part 130 may be structured to be perpendicular to the inner circumferential surface of the main body part 110 in a cross-sectional view.

The protrusion part 130 serves as a handle used to physically remove the ear tip 100 from a mold.

An operator's hand or a working tool may hold the protrusion part 130 according to the present exemplary embodiment and easily lift up the ear tip 100 immediately after the ear tip 100 is formed, thereby removing the completely manufactured ear tip 100 from the mold.

The external auditory canal contact part 140 has a structure radially protruding from an outer circumferential surface of a lower end of the main body part 110 and extending upward by a predetermined height and is configured to come into contact with the inner surface of the wearer's external auditory canal.

Specifically, the external auditory canal contact part 140 may have a specific structure including an external auditory canal insertion lower end portion 141, an intermediate connection portion 142, and an upper end portion 143.

The external auditory canal insertion lower end portion 141 is formed integrally with the outer circumferential surface of the lower end of the main body part 110 and extends upward in a state of being spaced apart from the outer circumferential surface of the lower end of the main body part 110 by a predetermined distance. The external auditory canal insertion lower end portion 141 may form/define an inner groove 144 together with the outer circumferential surface of the main body part 110.

The intermediate connection portion 142 is formed integrally with the external auditory canal insertion lower end portion 141 and extends upward from the external auditory canal insertion lower end portion 141. The intermediate connection portion 142 may have a structure having an outer diameter that increases upward in a transverse sectional view.

The upper end portion 143 is formed integrally with the intermediate connection portion 142 and extends upward from the intermediate connection portion 142 by a predetermined height. The upper end portion 143 may have a hollow cylindrical structure having an outer diameter equal to that of an upper end of the intermediate connection portion 142.

In some instances, a height H of an upper end of the upper end portion 143 may be larger than that of the upper end of the main body part 110 by a thickness T of the main body part 110. When the earphone is coupled to the main body part 110, a surface of the user's ear and an outer surface of the earphone may come into contact with each other. In this case, the user may feel a feeling of irritation in his/her ear due to the hard outer surface of the earphone. In order to avoid this problem, the external auditory canal contact part 140 may have the structure extending further than the upper end of the main body part 110 by a predetermined length so that the earphone and the surface of the user's ear do not come into contact with each other.

In addition, since the ear tip 100 according to the present disclosure has the external auditory canal contact part 140 having the specific structure including the external auditory canal insertion lower end portion 141, the intermediate connection portion 142, and the upper end portion 143, it is possible to provide the ear tip 100 that may come into surface contact with the inner surface of the wearer's external auditory canal and simultaneously and stably fix the position of the ear tip.

FIG. 5 is a cross-sectional view illustrating an ear tip according to another exemplary embodiment of the present disclosure.

Referring to FIG. 5, the intermediate connection portion 142 according to the present exemplary embodiment may be made of a shape-memory polymer (SMP) which may be restored to an original state by a temperature of a human body. The shape-memory polymer (SMP) is a type of smart polymer that may be restored to an original state from a temporarily deformed state by external stimulation and environmental changes. In comparison with a shape-memory alloy which is another shape-memory material, the shape-memory polymer (SMP) has an advantage in that the shape-memory polymer is manufactured at low cost and easy to process.

In this case, according to the ear tip 100 according to the present disclosure, since the intermediate connection portion 142 of the external auditory canal contact part 140 is made of a shape-memory polymer (SMP) configured to be restored to an original state by a temperature of a human body, it is possible to provide the ear tip configured such that after the ear tip is inserted into the wearer's external auditory canal, the intermediate connection portion 142 may be restored to the original state and the upper end portion 143 of the external auditory canal contact part 140 may be in close contact with the inner surface of the wearer's external auditory canal.

FIG. 6 is a cross-sectional view illustrating an ear tip according to still another exemplary embodiment of the present disclosure, and FIG. 7 is a cross-sectional view illustrating an ear tip according to yet another exemplary embodiment of the present disclosure.

Referring to these drawings, one or more protrusion parts 130 according to the present exemplary embodiment may be formed on the inner circumferential surface of the lower portion of the main body part 110 so as to be spaced apart from one another by a predetermined distance.

The protrusion part 130 according to the present exemplary embodiment is used as a handle for separating the completely formed ear tip 100 from the mold. Therefore, the structure of the protrusion part 130 and the number of protrusion parts 130 may be set in such a manner as to more easily remove the ear tip 100 from the mold.

FIG. 8 is a cross-sectional view illustrating an ear tip according to still yet another exemplary embodiment of the present disclosure.

According to the present exemplary embodiment, the structure of the protrusion part 130 and the number of protrusion parts 130 may be variously set so that the protrusion part 130 may be used as an optimum handling tool as described above.

Specifically, as illustrated in FIGS. 8A to 8D, the protrusion parts 130 may be spaced apart from one another by a predetermined distance and grouped into a single group. In this case, protruding lengths of the plurality of protrusion parts 130 constituting the single group may relatively increase toward a lower side, a middle side, or an upper side of the protrusion parts.

In this case, according to the ear tip 100 according to the present disclosure, the plurality of protrusion parts 130 is formed on the inner circumferential surface of the lower portion of the main body part 110 so as to be spaced apart from one another by a predetermined distance, and the protrusion parts 130 have the various protruding lengths. As a result, it is possible to provide the ear tip 100 including a structure physically and easily removable from a mold without the aid of a separate chemical substance even though a material having high adhesiveness is applied in a manufacturing process.

As described above, since the ear tip according to the present disclosure has the specific structure including the main body part, the coupling part, the protrusion part, and the external auditory canal contact part, it is possible to provide the ear tip including a structure easily and physically removable from a mold without the aid of a separate chemical substance even though a material having high adhesiveness is applied in a manufacturing process.

In addition, since the ear tip according to the present disclosure has the main body part having the specific structure including the lower end portion, the intermediate connection portion, and the upper end portion, it is possible to provide the ear tip that may be stably mounted on one side of the earphone, may be smoothly inserted into the inner surface of the wearer's external auditory canal, and may stably fix a wearing position after being inserted.

In addition, since the ear tip according to the present disclosure has the external auditory canal contact part having the specific structure including the external auditory canal insertion lower end portion, the intermediate connection portion, and the upper end portion, it is possible to provide the ear tip that may come into surface contact with the inner surface of the wearer's external auditory canal and simultaneously and stably fix the position of the ear tip.

In addition, according to the ear tip according to the present disclosure, since the intermediate connection portion of the external auditory canal contact part is made of a shape-memory polymer (SMP) configured to be restored to an original state by a temperature of a human body, it is possible to provide the ear tip configured such that after the ear tip is inserted into the wearer's external auditory canal, the intermediate connection portion may be restored to the original state and the upper end portion of the external auditory canal contact part may be in close contact with the inner surface of the wearer's external auditory canal.

In addition, according to the ear tip according to the present disclosure, the plurality of protrusion parts is formed on the inner circumferential surface of the lower portion of the main body part so as to be spaced apart from one another by a predetermined distance, and the protrusion parts have the various protruding lengths. As a result, it is possible to provide the ear tip including a structure physically and easily removable from a mold without the aid of a separate chemical substance even though a material having high adhesiveness is applied in a manufacturing process.

Only the specific exemplary embodiments have been disclosed in the above-mentioned detailed description of the present disclosure. However, it should be understood that the present disclosure is not limited to the specific forms mentioned in the detailed description, but rather, it should be understood that the present disclosure includes all modifications, equivalents, and substitutes within the spirit and scope of the present disclosure defined by the appended claims.

That is, the present disclosure is not limited to the specific exemplary embodiments and descriptions, various modifications can be made by any person skilled in the art to which the present disclosure pertains without departing from the subject matter of the present disclosure as claimed in the claims, and the modifications are within the scope defined by the claims.

What is claimed is:

1. An ear tip, which is mounted on one side of an earphone and configured to be inserted into a wearer's external auditory canal to stably fix a position of the earphone, the ear tip comprising:

a main body part having a hollow cylindrical structure corresponding to an outer circumferential surface of the earphone;

a coupling part formed to have a ring structure along an inner circumferential surface of an upper portion of the main body part and having a protrusion structure corresponding to a recessed coupling structure formed on the outer circumferential surface of the earphone;

one or more protrusion parts formed to have a ring structure along an inner circumferential surface of a lower portion of the main body part and having a protrusion structure protruding by a predetermined height, the protrusion part being disposed to be spaced apart from the coupling part by a predetermined distance; and an external auditory canal contact part having a structure radially protruding from an outer circumferential surface of a lower end of the main body part and extending upward by a predetermined height, the external auditory canal contact part being configured to contact with an inner surface of the wearer's external auditory canal, wherein a plurality of the protrusion parts is formed on the inner circumferential surface of the lower portion of the main body part so as to be spaced apart from one another by a predetermined distance, and wherein the plurality of the protrusion parts are spaced apart from one another by the predetermined distance and grouped into a single group, and protruding lengths of the plurality of the protrusion parts constituting the single group relatively increase toward a lower side, a middle side, or an upper side.

2. The ear tip of claim 1, wherein the main body part comprises:

a lower end portion having inclined portions and inclined downward at a predetermined angle and formed in the form of a continuous closed curve on an inner circumferential surface and an outer circumferential surface of the lower end portion so that the lower end portion is smoothly inserted into the inner surface of the wearer's external auditory canal;

an intermediate connection portion having a cylindrical structure extending upward by a predetermined height from the lower end portion and configured to continuously connect the lower end portion and an upper end portion; and the upper end portion formed integrally with an upper end of the intermediate connection portion and configured such that an inclined portion inclined upward at a predetermined angle is formed in the form of a continuous closed curve on an outer circumferential surface of an upper end of the upper end portion.

3. The ear tip of claim 1, wherein the external auditory canal contact part comprises:

an external auditory canal insertion lower end portion formed integrally with the outer circumferential surface of the lower end of the main body part and extending upward in a state of being spaced apart from the outer circumferential surface of the lower end of the main body part by a predetermined distance, the external auditory canal insertion lower end portion being configured to form an inner groove together with the outer circumferential surface of the main body part;

an intermediate connection portion formed integrally with the external auditory canal insertion lower end portion and extending upward from the external auditory canal insertion lower end portion, the intermediate connection portion having an outer diameter that increases upward in a transverse sectional view; and an upper end portion formed integrally with the intermediate connection portion and extending upward from the intermediate connection portion by a predetermined height, the upper end portion having a hollow cylindrical structure having an outer diameter equal to an outer diameter of an upper end of the intermediate connection portion.

4. The ear tip of claim 3, wherein the intermediate connection portion is made of a shape-memory polymer (SMP) which is restored to an original state by a temperature of a human body, and wherein, after the ear tip is inserted into the wearer's external auditory canal, the intermediate connection portion is restored to the original state, and the upper end portion of the external auditory canal contact part is in close contact with the inner surface of the wearer's external auditory canal.

* * * * *